United States Patent [19]

Groeger et al.

[11] Patent Number: 4,481,792

[45] Date of Patent: Nov. 13, 1984

[54] COLD STORAGE PACK

[76] Inventors: Theodore C. Groeger, 8 Davenport Ave., Roseland, N.J. 07068; Theodore O. Groeger, 2 Collamore Circle, West Orange, N.J. 07052

[21] Appl. No.: 543,050

[22] Filed: Oct. 21, 1983

[51] Int. Cl.[3] ..... F25D 3/08

[52] U.S. Cl. ..... 62/457

[58] Field of Search ..... 62/457, 371, 372, 529, 62/530

[56] References Cited

U.S. PATENT DOCUMENTS

| | | | |
|---|---|---|---|
| 3,401,535 | 9/1968 | Palmer | 62/457 |
| 3,802,220 | 4/1974 | Pompo | 62/457 X |
| 3,974,658 | 8/1976 | Starrett | 62/457 X |
| 4,266,407 | 5/1981 | Gibson | 62/457 X |
| 4,295,345 | 10/1981 | Atkinson | 62/457 |

*Primary Examiner*—Lloyd L. King

*Attorney, Agent, or Firm*—Theodore O. Groeger

[57] ABSTRACT

A cheap, compact container for cold-storing beverage or food cans and/or bottles, comprising: (a) a pair of symmetrical, heat-insulating solid blocks with a plurality of semicylindrical indentations therein, spaced at a distance from each other and the boundaries of the blocks; (b) at least one heat-conducting solid foil continuously lining a part of the indentations in either block; (c) at least one heat-absorbing can within an indentation of either block; and (d) fastening means for connecting both blocks so that cylindrical chambers are maintained therein.

11 Claims, 2 Drawing Figures

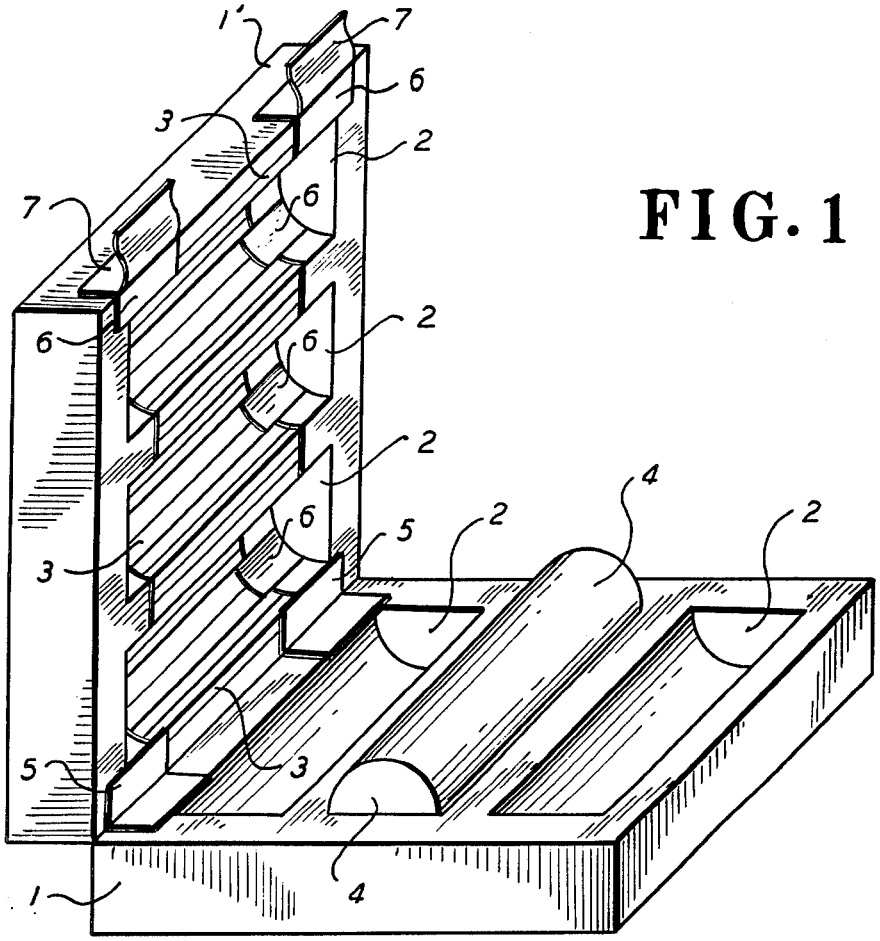
FIG. 1
FIG. 2
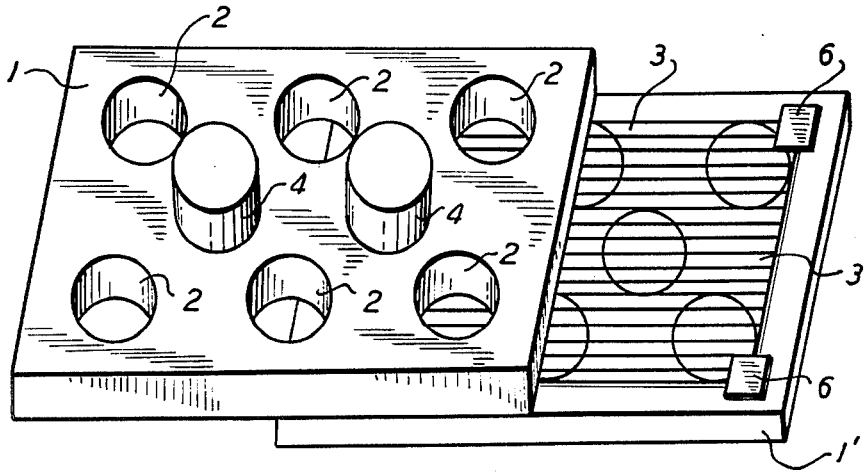

COLD STORAGE PACK

BACKGROUND OF THE INVENTION

The cold storage of beverage or food cans and bottles is conventionally accomplished with a heat-insulating box, containing ice, ice bags, or containers filled with heat-absorbing salt solutions. These boxes are usually larger than necessary, and rather inefficient when their contents are not immersed in ice-water. In the latter case, spills occur frequently. The "freezing of foods by immersion in an ice and salt brine" was patented in England as early as 1842 (Encylcopaedia Britannica, Vol. 9, p. 546, 1968). However, the spoiling brine was soon confined in said containers, whose heat-absorbing capacity is regenerated in conventional refrigerators .

Due to the current standardization of cans and bottles, their cold storage container should be standardized as well, what is the primary object of this invention, i.e. the provision of six-packs not much larger than the conventional can- or bottle-packs. Another object of this invention is the substitution of the rather expensive, non-standardized plastic containers filled with the heat-absorbing agent, by standardized heat-absorbents self-made from an empty can, filled with table salt and water, closed, and refrigerated as usual. A third object of this invention is the provision of a dry, and more efficient cold storage pack, wherein the heat-absorbent is in heat-conducting contact with the beverage or food cans and bottles.

SUMMARY

The present invention concerns and has for its object the provision of a cheap, compact, and efficient cold storage container for beverage or food cans and/or bottles of approximately identical volume and cylindrical shape. It ranges from a two- to twentyfour-pack, preferably a six- to twelve-pack.

Said container comprises: (a) a pair of symmetrical, heat-insulating blocks with a plurality of approximately semicylindrical indentations therein, spaced at a distance from each other and the boundaries of said blocks; (b) at least one heat-conducting foil continuously lining a substantial part of said indentations in either block; (c) at least one heat-absorbing cylinder closely fitting into any of said indentations; and (d) fastening means for connecting both blocks so that approximately cylindrical chambers are maintained therein.

Said chambers approximate substantially the right, circular cylinder, i.e. the geometrical boundary of conventional beverage or food cans and short-necked bottles. However, if the shape of the latter significantly deviates from said cylinder, said chambers (formed from the corresponding semicylindrical indentations) may have the composite boundary of one right, circular cylinder, and one or two capping truncated cone(s).

This invention also concerns any new part, and combination of parts disclosed herein, the process for their manufacture, as well as their use.

BRIEF DESCRIPTION OF THE DRAWINGS

FIG. 1 is a perspective view of an opened (disconnected) cold storage two-pack with semicylindrical indentations of the chambers' whole altitude.

FIG. 2 is a perspective view of half of a cold storage six-pack with semicylindrical indentations of half of the chambers' altitude, whose bottom (top) part is 50% dislocated to the right.

Said simplified drawings illustrate schematically the present invention, and the numerals 1–7 therein refer to similar parts throughout the specification. They are collectively defined as follows: 1=heat-insulating block, 2=semicylindrical indentation therein, 3=heat-conducting foil, 4=heat-absorbing cylinder, 5–7=various fastening means.

DESCRIPTION OF THE PREFERRED EMBODIMENTS

According to FIG. 1, the pair of symmetrical, heat-insulating blocks 1 and 1' is hinged to each other with two adhesive tapes 5. Three semicylindrical indentations 2 are provided for two cans or bottles to be cold stored, and one heat-absorbing cylinder 4, all of which are in contact with the heat-conducting foil 3, lining the curved portions of said indentations 2. Said foil 3 is also attached to block 1' with several adhesive tapes 6. Although cylinder 4 must not be located in the middle-indentation 2, any asymmetrical cold storage pack will not operate optimally. When filled with said cans or bottle, both blocks 1 and 1' are closed, or connected to each other respectively, via said hinge-tapes 5, and another pair of adhesive tapes 7, to be attached to the unlined block 1, so that three (fully) cylindrical chambers are maintained therein during cold storage. In order to minimize the accumulation of water via condensation of air-humidity, and to maximize the cooling efficiency, the boundaries of said chambers will closely approximate those of the contents thereof, i.e. said cans or bottles and cylinder 4. As mentioned in the outset, the latter may be an identical (emptied) can, which has been filled with water or brine, closed, and refrigerated to about zero to about minus ten degrees Celsius. Variously, the influx of humidity may be minimized by substituting said hinge-tapes 5, and fastening tapes 7, by a single tape of the blocks' full length, thus closing the longer, opposite gaps in between.

FIG. 2 depicts only one of two symmetrical, but otherwise identical halves of a cold storage six-pack, whose bottom (or top) layer has been 50% dislocated to the right, for the sake of clarity. Its heat-insulating block 1 contains eight semicylindrical indentations 2, extending to the heat-conducting foil 3, which lines the plane portions of all of said indentations (holes) 2 therein. Said block 1 is attached (gluded) to the foil-covered block 1' of the same, or another heat-insulating material, but for exposing foil 3 more clearly, block 1' is shown dislocated from block 1. As mentioned before, the middle-indentations 2 advantageously contain (at most) two heat-absorbing cylinders 4, which show their imprints (rims) on the foil 3 as well. Said composite block 1+1' is further filled with up to six cans or bottles, and closed with another (empty) block 1+1', and the pair is held in place via the frictional contact of said cylinders 4 with said middle-indentations 2 in either block 1 of said halves. Again, efficiency and dryness of this six-pack may be improved by closing part, or the whole gap between said adjacent blocks 1 with an adhesive tape.

The materials utilized for the cold storage packs according to this invention are advantageously these:

(a) Styrofoam and similar solid (rigid) polymeric foams, balsa- or corkboard, compacted cornstalk, paper or wood pulp, and the like, for the heat-insulating blocks 1 and 1'.

(b) Aluminum, tin or steel foils, similar metal powder-plastic foil composites, or metallic paint layers as heat conductors 3.

(c) Cylindrical aluminum or steel cans filled with water or aqueous salt solutions, e.g. brines of sodium or calcium chloride, sodium sulfate, and the like, refrigerated to about 0° to minus 20° C., as heat absorbers 4.

(d) Adhesive tapes, bands, belts, strings, bolts, screws, locks and/or magnets, e.g. barium ferrites, and the like, as fastening means 5–7, which are conventionally utilized for boxes or luggage also. Thus, for example, the FIG. 2 halves of the depicted six-pack may be held in place magnetically, if said cylinders 4 are made of a ferrous material, and the blocks 1' have magnetic barium ferrite pellets embedded underneath the non-ferrous foil 3, e.g. in the center of the indentations of the cylinders' rims therein. Variously, the FIG. 1 two-pack-halves 1 and 1' may contain attracting magnet pellets underneath the tapes 6 adjacent to 7, thus substituting the latter adhesive fastening means.

If not mentioned already, the cold storage packs according to this invention are constructed of any suitable and cheap material utilized for purpose-similar containers, or parts thereof, and according to conventional engineering techniques.

We claim:

1. A cold storage container comprising: (a) a pair of symmetrical, heat-insulating blocks with a plurality of approximately semicylindrical indentations therein, spaced at a distance from each other and the boundaries of said blocks; (b) at least one heat-conducting foil continuously lining portions of all of said indentations in either block; (c) at least one heat-absorbing cylinder closely fitting into any of said indentations; and (d) conventional fastening means for connecting both of said blocks so that approximately cylindrical chambers are maintained therein.

2. A container according to claim 1, wherein said indentations' altitude is identical with that of said chambers.

3. A container according to claim 1, wherein said indentations' altituded is half of that of said chambers.

4. A container according to claim 1, wherein at most one third of said indentations are fitted with said heat-absorbing cylinder.

5. A container according to claim 1, wherein at least one sixth of said indentations are fitted with said heat-absorbing cylinder.

6. A container according to claim 1, wherein said fastening means are a plurality of adhesive tapes.

7. A container according to claim 1, wherein said fastening means comprise at least one permanent magnet within each of said blocks, in conjunction with at least one ferrous heat-absorbing cylinder.

8. A container according to claim 1, wherein said heat-insulating blocks consist of a solid polymeric foam.

9. A container according to claim 8, wherein said foam is styrofoam.

10. A container according to claim 1, wherein said heat-conducting foil consists of aluminum.

11. A container according to claim 1, wherein said heat-absorbing cylinder consists of a conventional beverage can, filled with water, closed, and refrigerated to about zero to abut minus ten degrees Celsius.

* * * * *